United States Patent [19]

Smith et al.

[11] Patent Number: 4,488,658

[45] Date of Patent: Dec. 18, 1984

[54] TAMPER EVIDENT FOOD PACKAGE

[75] Inventors: Ernest L. Smith, Kansas City, Mo.; Donald L. Kraft, Lenexa, Kans.

[73] Assignee: Sealright Co, Inc., Kansas City, Mo.

[21] Appl. No.: 560,325

[22] Filed: Dec. 12, 1983

[51] Int. Cl.[3] ..... B65D 17/40

[52] U.S. Cl. ..... 220/276; 220/270; 220/307

[58] Field of Search ..... 220/270, 276, 307; 215/256

[56] References Cited

U.S. PATENT DOCUMENTS

| | | | |
|---|---|---|---|
| 3,420,397 | 1/1969 | Miller | 220/307 |
| 3,425,592 | 2/1969 | Vogel | 220/276 |
| 3,465,910 | 9/1969 | Richie | 220/270 |
| 3,773,207 | 11/1973 | Dokosupil et al. | 220/270 |
| 4,212,409 | 7/1980 | Jeppsson | 220/276 |
| 4,350,263 | 9/1982 | Hoffman | 220/359 |

*Primary Examiner*—George T. Hall

*Attorney, Agent, or Firm*—Kokjer, Kircher, Bradley, Wharton, Bowman & Johnson

[57] ABSTRACT

A tamper evident package for perishable foods such as dairy products. A container which holds the food has an outwardly rolled rim. A skirted lid covers the container and has a peripheral flange overlying the container rim and a downturned skirt which is pressed inwardly beneath the rim to initially secure the lid on the container. Cuts are formed through the flange and separated by frangible webs to provide a line of detachment permitting the skirt to be torn away. The lid can be initially removed only by breaking at least one of the webs, and the condition of the webs thus provides an indication of whether or not the package has been opened. The package is formed by filling the container, applying the lid, pressing the skirt of the lid inwardly beneath the container rim with a heated forming head, and using die mounted heated blades to make the cuts.

12 Claims, 4 Drawing Figures

TAMPER EVIDENT FOOD PACKAGE

BACKGROUND AND SUMMARY OF THE INVENTION

This invention relates generally to the packaging of foods and more particularly to a food container and closure which provide a visual indication of unauthorized opening and other tampering. The invention also relates to a method of forming a tamper evident food package.

Food such as cottage cheese, sour cream, yogurt and other dairy products are normally packaged in relatively inexpensive containers formed from injection molded plastic or coated paperboard. It is necessary that the lid fit tightly on the container in order to give the dairy product a prolonged shelf life. The periphery of the lid and the rim of the container are usually formed such that they mechanically interlock in order to hold the lid in place and effectively seal the contents of the container. The lid can simply by lifted off of the container to gain access to the contents, and it can be replaced by pressing it back onto the container to again seal the contents.

This conventional type of food package has been generally satisfactory for the packaging of dairy products, primarily because it permits the contents to be partially removed and the remaining contents to be effectively sealed. However, it is less than satisfactory in other respects. One important drawback is that the lid can be removed and replaced without leaving any visible evidence that the container has been opened. Therefore, it is possible for tampering with the contents to take place on the store shelf without purchasers or store personnel being alerted to the tampering. The deterrence of tampering with foods and other consumable products has taken on increased importance in recent years.

To our knowledge, there has not in the past been available an economical food package suitable for dairy products which is constructed to give a clear visible sign indicating that there has been an unauthorized opening. It is the principal goal of the present invention to provide such a tamper evident food package, along with an economical method of packaging foods therein.

More specifically, it is an important object of the invention to provide a package for food products which visibly indicates whether or not the package has been opened. In accordance with the invention, a skirt on the periphery of the lid is pressed beneath the outwardly rolled container rim to secure the lid in place on the container. The rim or flange portion of the lid is cut to form a weakend tear line interrupted by frangible web portions of the flange. Before the container can be initially opened, at least one of the webs must be broken to permit the skirt to release from the container rim. Consequently, consumers and store personnel can detect whether tampering with the food package has taken place simply by noting whether or not one or more of the webs is broken.

Another object of the invention is to provide a tamper evident closure which can be replaced to tightly seal the container contents following initial opening of the container. After the lid has been initially removed, the skirt can be completely severed from the lid by tearing it along the weakened tear line formed by the cuts. When the lid is thereafter replaced on top of the container, a rib on the periphery of the lid fits closely in a mating groove in the container wall to hold the lid in place on the container. As another important feature of the invention, the detachable strip leaves a projecting tap on the lid to provide a convenient finger grip which facilitates subsequent removal of the lid.

A further object of the invention is to provide a tamper evident food package which retains an attractive, finished appearance following detachment of the removable tear strip. In this respect, it is an important feature of the invention that the ends of the cuts are curved inwardly to avoid the formation of unattractive nibs or other unsightly projections along the tear line.

An additional object of the invention is to provide a tamper evident food package which is constructed simply and economically and which is especially well suited for the packaging of perishable foods such as dairy products in the nature of cottage cheese, sour cream and yogurt.

Yet another object of the invention is to provide a simple and economical method of packaging dairy products and other foods in a tamper evident package.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith an in which like reference numerals are used to indicate like parts in the various views.

Figure 3:
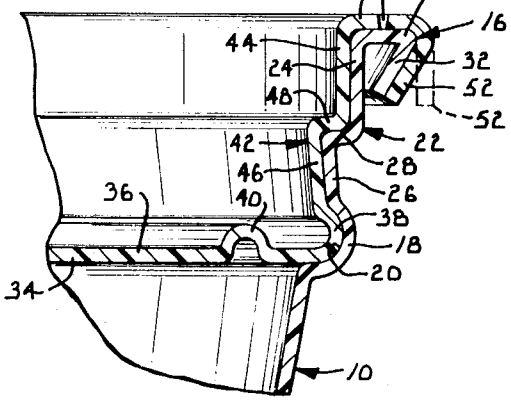
FIG. 3 is a fragmentary sectional view on an enlarged scale taken generally along line 3—3 of FIG. 2 in the direction of the arrows, with the broken lines indicating the initial position of the skirt on the periphery of the lid before it is pressed inwardly to secure the lid in place.

Referring now to the drawing in more detail, numeral 10 generally designates a container which holds perishable foods such as dairy products in the nature of cottage cheese, sour cream or yogurt. The container 10 has a frustoconical side wall 12 which is closed at the bottom 14 by a discoidal bottom panel. The container 12 is open at the top and terminates at its upper edge in an outwardly rolled rim 16. The rim 16 is circular.

Figure 4:
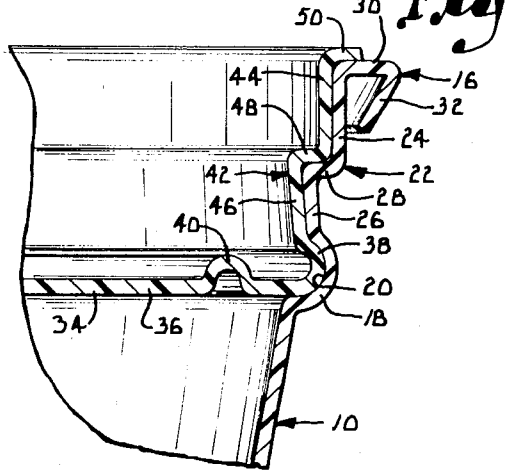
FIG. 4 is a fragmentary sectional view similar to FIG. 3 but showing the tear strip detached from the lid.
Figure 1:
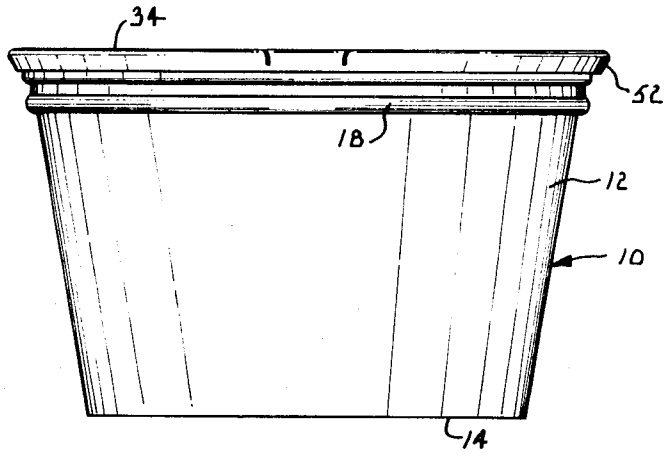
FIG. 1 is a side elevational view of a tamper evident food package constructed according to a preferred embodiment of the present invention.

As best shown in FIGS. 3 and 4, the container side wall 12 is provided with an outwardly projecting rib 18 located somewhat below rim 16. The rib 18 is rounded and presents a similarly rounded groove 20 in the inside surface of the side wall 12. Extending between the rib 18 and rim 16 is a generally vertical wall 22. The wall 22 has a stepped configuration to provide upper and lower wall sections 24 and 26 connected by a generally horizontal shoulder 28.

The outwardly rolled rim 16 on the top edge of the container 10 includes an annular flange 30 which extends generally outwardly from the upper edge of the top wall section 24. Flange 30 is substantially flat and horizontal and has a lip 32 extending from its outer edge. The lip 32 projects generally downwardly and somewhat inwardly.

The container 10 is preferably formed in a single integral piece by injection molding or thermoforming a suitable plastic material such as polyethylene, polypropylene or polystyrene. Alternatively, the container can be formed of another suitable material and may be fabricated by techniques other than injection molding.

The open top of the container 10 is covered by a closure or lid 34 which seals the contents of the container. The closure 34 has a flat, discoidal body 36 which presents a rounded rib 38 on its periphery. The rib 38 is complemental in size and shape to the groove 20 in the container side wall. An annular ridge 40 extends upwardly from the lid body 36 at a location spaced inwardly from its periphery.

The periphery of the closure 34 includes a generally vertical wall 42 which extends upwardly from the rib 38. The wall 42 has a stepped configuration to provide upper and lower wall sections 44 and 46 connected by a horizontal shoulder 48. Projecting outwardly from the top edge of the upper wall section 44 is an annular rim or flange 50 which directly overlies the flange 30 on the container rim 16. A skirt 52 is formed on the outer edge of the flange 50. Skirt 52 initially extends downwardly from flange 50 as indicated by the broken lines in FIG. 3. After the lid has been applied, skirt 52 is pressed inwardly against the lip 32 in order to partially underly the rim 16, as shown by the solid lines in FIG. 3. Skirt 52 thereby secures the closure 34 on top of the container 10.

Figure 2:
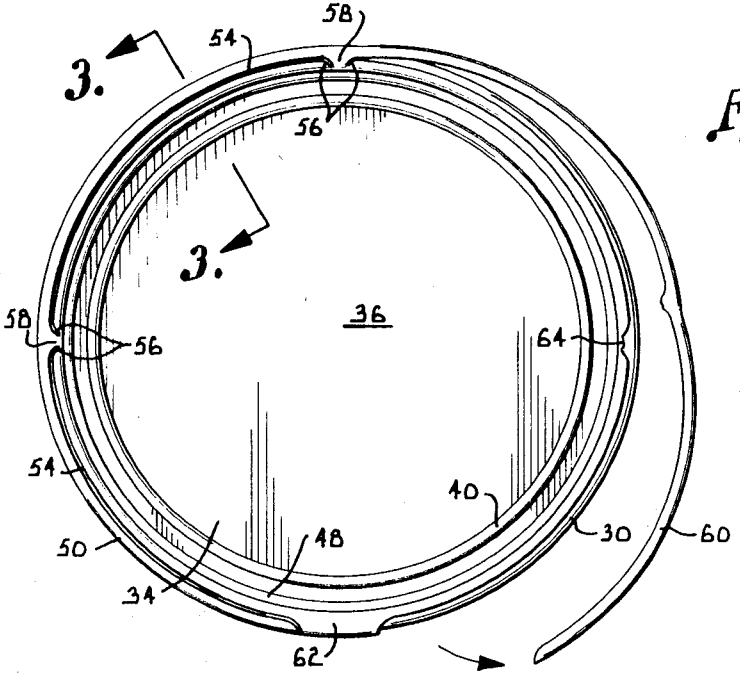
FIG. 2 is a top plan view of the food package showing the detachable tear strip partially torn away from the container lid.

As best shown in FIG. 2, the flange 50 of the closure is provided with four arcuate slits or cuts 54, each of which extends through an arc slightly less than 90°. The adjacent ends of the cuts 54 are curved inwardly as indicated at 56, and the curved end portions 56 are spaced apart to leave a plurality of frangible web portions 58 of flange 50 between the adjacent ends of the cuts. The web 58 are three in number and are spaced apart from one another approximately 90° on the flange 50. The cuts 54 are arranged generally end to end and extend substantially completely around the flange 50 to define a weakened line of detachment or tear line along which a tear strip 60 (FIG. 2) can be torn away from the remainder of the lid. The tear strip 60 is formed by the skirt 52 and the outer portion of the flange 50. The webs 58 and a tab 62 initially hold the tear strip 60 on the lid.

The tab 62 is formed between the ends of two of the cuts 54. These cuts are curved outwardly at their ends rather than inwardly, and the outwardly curved ends are spaced apart to provide the tab 62 with considerably more breadth that the webs 58. The tab 62 is large enough to provide a finger grip which facilitates removal of the lid, as will be explained more fully.

The closure 34 is preferably formed by injection molding of a suitable plastic such as polyethylene, polypropylene or polystyrene. However, it is to be understood that the lid can be formed from other materials and by other techniques.

After the open topped container 10 has been formed, the food product is inserted into the container before the lid is applied. It is contemplated that the container will hold perishable foods such as cottage cheese, sour cream, yogurt and similar dairy products.

The closure 34 is initially molded or otherwise formed with the skirt 52 extending almost straight downwardly from the outer edge of the flange 50, as shown by the broken lines in FIG. 3. After the container has been filled with food, the closure 34 is applied simply by pressing it onto the top portion of the container. The peripheral rib 38 on the lid snaps into the groove 20 in the container wall, and the close fit of the rib in the groove holds the lid in place on the container. The wall sections 44 and 46 on the periphery of the lid contact the respective wall sections 24 and 26, and shoulder 48 extends along and on top of shoulder 28. The snug contact between all of these surfaces provides an effective seal which gives the food product a prolonged shelf life. Flange 50 contacts the underlying flange 30, and the skirt 50 extends downwardly at a location outwardly of lip 32.

After the lid has been applied in this manner, the skirt 52 is curled or pressed inwardly against lip 32 to the solid line position of FIG. 3 by a heated head or similar device (not shown). The skirt 52 then secures the closure in place on top of the container. A die having heated blades or similar heated cutting elements is then engaged against the flange 50 to form the cuts 54 through the flange to complete the package.

The webs 58 and tab 62 hold strip 60 on the lid and maintain skirt 52 beneath the container rim 16 to secure the closure 34 on the package. Before the closure can be removed, it is necessary to break at least one of the webs 58 in order to permit skirt 32 to release from the rim 16. Consequently, the condition of the webs 58 provides visual evidence as to whether or not there has been an unauthorized opening or other tampering with the container. If none of the webs are broken, the container has not been opened. Conversely, if one or more of the webs has been broken, visible evidence is provided that the container has been opened or that tampering has occurred.

Normal opening of the container is initially accomplished by gripping the tear strip 60 and tearing it away from the remainder of the lid along the weakened tear line provided by the cuts 54. The opposite ends of the strip 60 are torn away from the tab 62, and all three of the webs 58 are broken to detach strip 60. Then, skirt 52 is removed from the lid and the lid can be removed simply by lifting if off of the top of the container. The tab 62 provides a convenient finger grip which facilitates removal of the lid. The closure 34 can be replaced to reseal any remaining contents of the container. Replacement of the lid involves simply pressing it down into the top of the container such that the rib 38 snaps into the groove 20. The container is then tightly closed and the contents are sealed by the tight fit of the periphery of the lid against the inside surface of the container side wall 12. The lid can subsequently be removed and replaced any number of times.

The inwardly curved ends 56 of cuts 54 maintain the attractive, finished appearance of the lid even after the strip 60 has been torn away. When the webs 58 are broken, jagged nibs such as the nib 64 (FIG. 2) are formed. Due to the inward curvature of the ends 56 of the cuts, the nibs 64 do not protrude outwardly beyond the rim of the container to detract from its pleasant appearance. Thus, the inwardly curved ends 56 provide the package with an attractive appearance and avoid creating an unfinished look after the tear strip 60 has been detached.

From the foregoing, it will be seen that this invention is one well adapted to attain all the ends and objects hereinabove set forth together with other advantages which are obvious and which are inherent to the structure.

It will be understood that certain features and subcombinations are of utility and may beemployed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, we claim:

1. A tamper evident closure for a food container having a sidewall terminating in an outwardly extending rim, said closure comprising:

a lid having a size to cover the container and a periphery disposed in contact with the container sidewall when said lid is applied to the container;

cooperating means on said periphery of the lid and the container sidewall for releasably holding said lid on the container to enclose the contents of the container; and a detachable strip on said periphery of the lid connected therewith along a line of detachment defined by a plurality of cuts arranged generally end to end and separated by a plurality of frangible webs located between adjacent ends of said cuts, said strip at least partially underlying the container rim to secure said lid thereon, whereby at least one of said webs must be broken to permit release of said strip from the container rim to release said lid for initial removal from the container.

2. A closure as set forth in claim 1, wherein each of said cuts has inwardly curved opposite end portions.

3. A closure as set forth in claim 1, including a tab portion of said lid located between a selected pair of cuts to provide a finger grip on said lid following detachment of said strip.

4. A closure as set forth in claim 1, wherein said cooperating means includes a groove in the container sidewall and a peripheral rib on said lid closely fitting in said groove when the lis is applied to the container.

5. A closure as set forth in claim 1, including:

a flange on said lid located to overlie the container rim when the lid is applied thereto, said cuts being formed through said flange; and a skirt extending from said flange beneath the container rim, said detachable strip being formed by said skirt and the part of said flange located on one side of said side line of detachment.

6. A closure as set forth in claim 5, including a peripheral walll on said lid located adjacent to said flange and contacting the container sidewall when said lid is applied to the container.

7. A tamper evident closure for a food container having a sidewall terminating in a generally circular rim, said closure comprising:

a discoidal lid for covering the container, said lid having a peripheral surface engaging the container sidewall in a manner to releasably hold the lid on the container and said lid having a wall section extending generally above said peripheral surface along the sidewall;

a flange extending generally outwardly from said wall section to overlie the rim of the container, said flange having a plurality of cuts therethrough arranged generally end to end to cooperate in defining a weakened line of detachment extending around the flange;

a tab portion of said flange formed thereon between adjacent ends of one pair of cuts;

a plurality of web portions of said flange formed thereon between the ends of the remaining cuts, said web portions being frangible to permit tearing of the flange along said line of detachment; and a skirt extending from said flange at least partially beneath the row of the container to secure said lid thereon, said skirt being removable from the rim to permit initial removal of said lid only after at least one of said web portions has been severed.

8. A closure as set forth in claim 7, wherein said cuts have inwardly curved end portions.

9. A closure as set forth in claim 7, wherein:

the sidewall of the container has a groove therein; and said peripheral surface of the lid includes a peripheral rib fitting closely of said groove when the lid is applied to the container.

10. A tamper evident package for food such as dairy products, said package comprising:

a container having a sidewall terminating in a generally circular rim extending outwardly from the top of the sidewall, said sidewall having an inside surface presenting a groove located below said rim;

a lid for said container having a peripheral rib fitting closely in said groove to releasably retain the lid on the container in a manner to seal the contents of the container;

a wall section of the lid extending above said rib generally along said inside surface of the container sidewall;

a flange extending from said wall section to generally overlie said rim;

a detachable skirt extending from said flange at a location and orientation to at least partially underlie said rim to secure said lid on the container;

a plurality of cuts through said flange arranged generally end to end but separated from one another to define a weakened line of detachment along which said skirt can be detached to permit removal of the lid from the container; and a plurality of frangible web portions of said flange located between the ends of adjacent cuts, whereby at least one of said web portions must be broken to permit said skirt to be removed from beneath said rim for initial removal of the lid from the container.

11. A package as set forth in claim 10, wherein each of said cuts has inwardly curved opposite end portion.

12. A package as set forth in claim 10, including a tab portion of said flange located between the ends of a selected pair of cuts to provide a finger grip on said lid after said skirt has been detached from the lid.

* * * * *